US009271584B1

(12) United States Patent
Weinstein et al.

(10) Patent No.: US 9,271,584 B1
(45) Date of Patent: Mar. 1, 2016

(54) PORTABLE DISPLAY STAND HAVING FOLDABLE ONE-PIECE VERTICAL SUPPORT PANEL THAT IS CAPABLE OF TOOL-FREE ASSEMBLY AND DISASSEMBLY

(71) Applicant: Specialty Store Services, Inc., Des Plaines, IL (US)

(72) Inventors: Eric Weinstein, Chicago, IL (US); Evan Finke, Northbrook, IL (US)

(73) Assignee: SPECIALTY STORE SERVICES, INC., Des Plaines, IL (US)

( * ) Notice: Subject to any disclaimer, the term of this patent is extended or adjusted under 35 U.S.C. 154(b) by 0 days.

(21) Appl. No.: 14/121,400

(22) Filed: Aug. 29, 2014

(51) Int. Cl.
*A47B 43/00* (2006.01)
*A47F 5/10* (2006.01)
*A47F 5/13* (2006.01)

(52) U.S. Cl.
CPC .... *A47F 5/10* (2013.01); *A47F 5/13* (2013.01)

(58) Field of Classification Search
CPC ..... A47F 5/10; A47F 5/13; A47F 5/108; A47F 5/135; E04B 2/7431; G09F 15/00; B62B 2205/12; B62B 1/12; Y10T 16/541
USPC ..... 211/190
See application file for complete search history.

(56) References Cited

U.S. PATENT DOCUMENTS

| | | | | | |
|---|---|---|---|---|---|
| 406,196 | A | * | 7/1889 | Clayton et al. | 248/413 |
| 3,502,292 | A | | 3/1970 | Yoder | |
| 3,583,466 | A | | 6/1971 | Dreyer | |
| 3,817,396 | A | * | 6/1974 | Markson | 211/198 |
| 4,127,196 | A | | 11/1978 | Boucher | |
| 4,727,994 | A | * | 3/1988 | Beaulieu | 211/198 |
| 4,784,205 | A | | 11/1988 | Johnson et al. | |
| 5,016,765 | A | | 5/1991 | Leonardo | |
| 5,090,725 | A | | 2/1992 | Feldner | |
| 5,255,803 | A | | 10/1993 | Pavone et al. | |
| 5,385,246 | A | | 1/1995 | Grossnickle | |
| 5,560,502 | A | * | 10/1996 | Hsiung | 211/195 |
| 5,579,703 | A | | 12/1996 | King | |
| 5,617,962 | A | | 4/1997 | Chen | |
| 5,918,750 | A | | 7/1999 | Jackson | |
| 6,131,560 | A | * | 10/2000 | Healy | 126/30 |
| 7,448,634 | B1 | * | 11/2008 | Raub | 280/79.3 |
| 7,874,090 | B2 | | 1/2011 | Flagg | |
| 7,980,519 | B2 | * | 7/2011 | Chen | 248/125.8 |
| 8,181,797 | B2 | * | 5/2012 | Edwards et al. | 211/195 |
| 8,959,813 | B2 | * | 2/2015 | Denby et al. | 40/606.03 |
| 2005/0252422 | A1 | * | 11/2005 | Sharpe et al. | 108/35 |

OTHER PUBLICATIONS

Specialty Store Services, Inc.; "Grid & Go Display"(p. 35); published in Specialty Store Services, Store Fixtures and Supplies, Growing Your Business is Our Business; Catalog # 9023 published Feb. 8, 2013 (USA).

* cited by examiner

*Primary Examiner* — Korie H Chan
(74) *Attorney, Agent, or Firm* — William P. Oberhardt

(57) ABSTRACT

A portable display stand for removable attachment of fixtures for the display of merchandise is disclosed. The display stand features a hinged vertical support panel sub-assembly, including top and bottom panel segments, to reduce size and promote portability. Slideable pin locks within top or bottom braces for the top and bottom panel segments slide out from a disengaged position and lock in the engaged position, stabilizing the top and bottom panel segments relative to each other, for assembly. The hinged connection between the braces for the top and bottom panel segments promotes fast alignment during assembly. Assembly of the vertical support panel sub-assembly and the first and second leg sub-assemblies occurs without tools. The display stand disassembles into three (maximum) portable sub-assemblies that may be transported in a carrying case, and may be reassembled without tools in less than a minute.

20 Claims, 5 Drawing Sheets

PORTABLE DISPLAY STAND HAVING FOLDABLE ONE-PIECE VERTICAL SUPPORT PANEL THAT IS CAPABLE OF TOOL-FREE ASSEMBLY AND DISASSEMBLY

BACKGROUND OF THE INVENTION

1. Technical Field

This invention is related to display stands, and, more particularly, to lightweight, portable display stands that may be readily assembled and disassembled without tools.

2. Prior Art

Display stands for exhibiting, among other things, merchandise or other items (together "merchandise") have been in wide use for many years. Various types of display stands are commonly seen in retail stores such as supermarkets, hardware stores, discount stores, and a multitude of other locations. Display stands may be permanent, semi-permanent, or temporary in nature.

Display stands typically include a perforated, slotted, or gridded support panel configuration that is oriented in a vertical direction, with the front of the panel facing the intended viewers. Perforated, slotted, or gridded vertical panels commonly include slatwall, gridwall, slatgrid, pegboard, or other designs for vertical support panels.

Removable fixtures for exhibiting or displaying merchandise include hooks, braces, shelves, or brackets that are adapted to fit into the perforations, slots, or grids of, or wrap around the support features of, the vertical support panel in a manner wherein the hooks, braces, shelves, or brackets are supported by the vertical support panel. The removable fixtures generally extend more or less outwardly from the front of the vertical support panel. The removable fixtures may be used to exhibit or display the merchandise itself (such as when a hook fits through a hole in the products' packaging to support the package on the hook). Removable fixtures may also, in turn, support shelving, baskets, or other associated support fixtures or accessories (together "accessories") that may be utilized to display merchandise.

The removable fixtures are commonly designed to be removable and re-arrangeable on the front of the vertical support panel of the display stand so as to promote flexibility in changing or refashioning the arrangement and appearance of merchandise displays.

While some display stands are permanent or semi-permanent, there is often a desire for at least some display stands at a given location to be temporary or portable, or both, in order to promote flexibility in the re-arrangement of the layout and configuration of display stands within the floorspace in that given location, or in multiple locations. Temporary and portable display stands are especially useful in promoting that flexibility.

Temporary and portable display stands are also especially desirable in environments where merchandise display stands are to be set up quickly, sometimes in locations far from the display stands' owner's usual location, displayed for a relatively short time, and then disassembled and removed quickly from that location, sometimes for transport and re-assembly elsewhere, and sometimes for transport and storage (short-term or long-term). The desirability of such temporary and portable display stands, for example, would exist for some display stands used at trade shows, craft shows, art shows, or conventions (together "trade shows"). In those instances, it is often very desirable that display stands be highly portable, be capable of being quickly and easily assembled (very preferably without tools, and with the display stand having minimal parts, to avoid separation and loss of or damage to or by those parts), be lightweight, be sturdy (to withstand the impact of the high volume of people accessing the displayed items at a trade show), be capable of being quickly and easily disassembled, and be easily and neatly packable, storable, and transportable in stored form. It is an unfortunate correspondence that prior art display stands that have been designed to promote portability and have lightweight structures generally are less sturdy, are prone to having many separable parts, and are often difficult to assemble or disassemble quickly (and require tools for such assembly and disassembly).

BRIEF SUMMARY OF THE INVENTION

Accordingly, prior to the invention of the display stand that is described further herein, a need remained for a display stand that included all of the following features, and properties discussed above, in a single display stand unit.

It is an object of this invention to provide a display stand that may be quickly and easily assembled, without tools.

It is a further object of this invention to provide a display stand that, when disassembled, includes very few individual, non-attached parts or sub-assemblies so as to avoid separation, loss, or damage of parts or sub-assemblies during assembly, disassembly, transport, or storage. In particular, in one of the preferred embodiments of the invention, the slotted, perforated, or gridded vertical support panel sub-assembly is formed of multiple connected segments to promote portability and easy storage, with the multiple segments of the vertical support panel sub-assembly being hinged to each other to form a one-piece construction, in order to prevent individual segments from being separated from each other, thereby avoiding loss of or damage to the multiple individual segments, and in order to facilitate fast and easy assembly and disassembly as a result of alignment facilitation resulting from the hinged construction. Relatedly, it is an object of the invention to promote easy disassembled stowage and transport of the display stand.

It is yet another object of the invention to provide a display stand design that promotes superior stability as compared to prior art portable display stand designs.

It is a further object of the invention to provide a display stand that may also be disassembled quickly and easily, without any tools.

It is a still further object of the invention to provide a display stand that, when disassembled, is compact and may, in preferred embodiments, be loaded into a carrying case capable of being carried with a single hand or strapped over a single shoulder so as to be easily stored and transported by a single person in stored form.

The portable display stand of the present invention includes a vertical support panel sub-assembly, preferably split into multiple segments, and more preferably split into two segments (a top panel segment and a bottom panel segment), with the split in the vertical support panel sub-assembly running in the horizontal direction across the face of the vertical support panel sub-assembly, preferably near the vertical mid-point of the vertical support panel sub-assembly. The vertical support panel sub-assembly is perforated, slotted, gridded, or otherwise adapted to accept removable fixtures, such as hooks, braces, shelves, brackets, or other accessories for displaying or exhibiting merchandise.

The vertical support panel sub-assembly is supported at its side edges by first and second vertical braces. The first and second vertical braces are preferably a hollow, tubular construction, and more preferably, constructed of a tubular metal. Preferably, the vertical braces are each split in the horizontal direction at a location that corresponds with the split between the top and bottom segments of the vertical support panel sub-assembly, so as to form a first top brace, a first bottom brace, a second top brace, and a second bottom brace.

The split between the first top brace and the first bottom brace frames a first gap in the first vertical brace. Likewise, the split between the second top brace and the second bottom brace frames a second gap in the second vertical brace. The first top brace includes a hollow tubular portion proximate to the first gap, and the second top brace includes a hollow tubular portion proximate to the second gap. The first bottom brace includes a hollow tubular portion proximate to the first gap, and the second bottom brace includes a hollow tubular portion proximate to the second gap. Furthermore, the first bottom brace includes a hollow tubular portion distal from the first gap, and the second bottom brace includes a hollow tubular portion distal from the second gap.

The first and second vertical braces are each attached to, and preferably permanently attached to, opposite sides of the vertical support panel sub-assembly, such as by welding or soldering, or are each formed integrally with opposite sides of the vertical support panel sub-assembly. The first top vertical brace is attached by a first hinge to the first bottom vertical brace, and the second top vertical brace is attached by a second hinge to the second bottom vertical brace.

The first and second hinges permit folding of the top panel segment and bottom panel segment of the vertical support panel sub-assembly, that is, the hinges permit folding (at the first gap and second gap) of the first top brace and first bottom brace, on the one hand, and the second top brace and second bottom brace, on the other hand, as well as the attached top panel segment and bottom panel segment of the vertical support panel sub-assembly, along the split in the horizontal direction of the panel located at or near the vertical midpoint, allowing compact stowing and easy transport of vertical support panel sub-assembly when folded. The first and second hinges maintain critical alignment of the first top brace and first bottom brace, as well as the second top brace and second bottom brace of the first and second vertical braces, respectively, when the vertical support panel sub-assembly is unfolded (for assembly) so that the first top brace and first bottom brace, on the one hand, and the second top brace and second bottom brace, on the other hand, align without the need for simultaneously visually and manually lining up the first and second top and bottom braces to permit the assembly and stabilization of the first and second vertical braces as discussed further herein. Simultaneously lining up tubular parts during assembly has been a particularly difficult and time consuming task in prior art portable display stands having multiple unconnected tubular parts, and particularly multiple unconnected tubular insertable parts, given the somewhat flexible and unwieldy nature of past designs for portable display stands.

In order to secure the vertical support panel sub-assembly and the first and second vertical braces in the unfolded (assembled) position, the portable display stand includes (preferably two) slideable pin locks (one for the first top brace and first bottom brace, and one for the second top brace and second bottom brace) which, when slid into engagement, fit snugly within the hollow tubular portions (proximate to the first and second gaps) of both the top and bottom braces of the first vertical brace, and both the top and bottom braces of the second vertical brace, respectively, so as to stabilize the top panel segment of the vertical support panel sub-assembly relative to the bottom panel segment of the vertical support panel sub-assembly.

The first and second slideable pin locks each include one or more locking mechanisms (such as bolts) which are preferably able to be hand locked (hand-tightened in the case of bolt locking mechanisms). When the slideable pin locks are in the non-engaged position, the first and second slideable pin locks fit inside of either the hollow tubular portions of the first and second top vertical braces proximate to the first and second gaps, or within the hollow tubular portions of the first and second bottom vertical braces proximate to the first and second gaps, and are secured in the non-engaged position using the locking mechanisms (such as the hand-tightened bolts previously mentioned).

When the vertical support panel sub-assembly is unfolded to the fully opened position and the hollow tubular portions of the first top brace and first bottom brace, and the second top brace and second bottom brace, respectively, are aligned, the slideable pin locks of the first and second vertical braces may be: (1) unlocked from the disengaged position (such as by loosening the hand-tightened bolts); (2) slid and extended partially from within the hollow tubular portions of either the first top brace or first bottom brace portions of the first vertical brace proximate to the first gap (wherever they are optionally situated in the disengaged position), and extended to fit snugly inside of the corresponding opposing hollow tubular portion of the first vertical brace, thereby strengthening and stabilizing the hinged connection of the first top brace and first bottom brace, and, as a result, strengthening and stabilizing the top panel segment and the bottom panel segment of the vertical support panel sub-assembly; (3) slid and extended partially from within the hollow tubular portion of either the second top brace or second bottom brace segments of the second vertical brace proximate to the second gap (where they are situated in the disengaged position), and extended to fit snugly inside of the corresponding opposing hollow tubular portion of the second vertical brace in order to further and similarly strengthen and stabilize the hinged connection of the second top brace and second bottom brace, thereby strengthening and stabilizing the top panel segment and the bottom panel segment of the vertical support panel sub-assembly; and (4) locked in the engaged position (such as by hand-tightening the bolts for the slideable pin locks).

Preferably, a slot is formed in the first and second bottom braces, and in the first and second top braces, to permit movement of the locking mechanisms of the first and second slideable pin locks between the disengaged and engaged positions. Because the first and second slideable pin locks are locked in the disengaged positions when the support panel sub-assembly is in the disassembled folded position, separation and potential loss of these small but critical parts, namely, the first and second slideable pin locks and associated locking mechanisms, especially during disassembly, storage, or transport, is avoided.

First and second leg sub-assemblies preferably include a horizontal leg support and a tubular vertical leg support that are permanently attached to each other, such as by welding or soldering. First and second leg sub-assemblies preferably are made of a tubular metal. First and second leg sub-assemblies may optionally be connected (temporarily or permanently, such as by welding or soldering) to each other before attachment to the vertical support panel sub-assembly, but preferably are not, because connection of the first and second legs to each other would require alignment and attachment of both of the vertical leg supports with the first and second bottom braces of both the first vertical and the second vertical brace simultaneously, a more difficult task than separately aligning and attaching the first and second leg sub-assemblies to the first and second bottom braces, respectively, one at a time.

Permanent attachment of the first and second leg sub-assemblies to each other would also render them unwieldy, making the display less portable.

Vertical leg supports extend preferably substantially transversely from at or near the midpoints of the horizontal leg supports. Preferably, leg levelers may be attached to the bottom of the horizontal leg supports. The leg levelers include headless bolts, or other known means, to permit leveling of the leg sub-assemblies on uneven surfaces. The headless bolts terminate in horizontal feet. The headless bolts screw inwardly and unscrew outwardly in their location in the bottoms of the horizontal leg supports and thereby may be shortened or lengthened as needed, by hand, in order to lower or raise the horizontal feet to level the portable display stand for stability. Other attachments (for example, casters) may be connected to the bottom of the horizontal leg supports as substitutes for the leg levelers, or the leg levelers or other attachments may be omitted in their entirety, without departing from the invention.

First and second leg sub-assemblies are attached to the first and second bottom braces, respectively. The tubular vertical leg supports fit snugly within the hollow tubular portions of the ends of the first and second bottom braces that are distal from the first gap and second gap, respectively.

The first and second leg sub-assemblies may then be secured to the hollow tubular portions of the first bottom brace and second bottom brace, respectively, using tool-free attachments. A preferable example of a tool-free attachment for attaching the first and second leg sub-assemblies may be one or more (preferably two) spring-plungers per leg sub-assembly which are preferably permanently attached to the hollow tubular portions of the first and second bottom braces that are distal from the first and second gaps, adjacent to brace apertures, and which, when engaged, cause the tips of plungers to fit through the brace apertures and then into corresponding leg apertures in the vertical leg supports of the first and second leg sub-assemblies. For assembly, the plungers are retracted (such as by pulling by hand) allowing the vertical leg supports to be fully inserted into the hollow tubular portions of the first and second bottom braces that are distal from the first and second gaps, and thereby permitting the leg apertures of the vertical leg supports to become aligned with the brace apertures and plungers. The plungers are then released and a spring bias causes the tips of the plungers to insert through the brace apertures into the corresponding aligned leg apertures, securing the leg sub-assembly in place. For disassembly, the plungers are retracted (by pulling) releasing the leg apertures so that the leg sub-assemblies may be removed (by lifting and sliding) in a tool-free manner. The spring-plungers preferably remain permanently attached to the hollow tubular portions of the first and second bottom braces adjacent to the brace apertures during disassembly.

An alternative tool-free attachment that may be used to secure the vertical leg supports of the first and second leg sub-assemblies to the first and second bottom braces are spring buttons. Spring buttons may be attached to the vertical leg supports (or to the first and second bottom braces) in a manner such that the buttons of the spring plungers engage corresponding apertures in the first and second bottom braces (or in the vertical leg supports). For disassembly, the spring buttons may be depressed, releasing the corresponding apertures of the vertical braces (or vertical leg supports), permitting removal of the leg sub-assemblies in a tool-free manner. The spring buttons are not removed from the leg sub-assemblies (or bottom braces) during disassembly of the portable display stand.

Optimally, a carrying case (preferably made of ballistic nylon or other suitable material) or other container of suitable size is used for stowing the (preferably a maximum of three) sub-assemblies of the portable display stand (the vertical support panel sub-assembly and the two leg sub-assemblies) when they are disassembled from each other. The small number of separate sub-assemblies when disassembled is highly advantageous. No small separable parts are required to be located for assembly or stored following disassembly, avoiding the risk of separation and loss of parts, or damage to or from loose parts, when they are disassembled or stowed. Assembly or disassembly of the portable display stand may occur entirely without tools, and may take place in less than a minute. The display stand, especially when stowed in the carrying case, is highly portable. It may be hand carried in the carrying case, which preferably includes a handle, or the carrying case may include a shoulder strap permitting the person carrying the stowed portable display stand to have his or her hands free for other purposes.

DETAILED DESCRIPTION OF THE INVENTION

Figure 1:
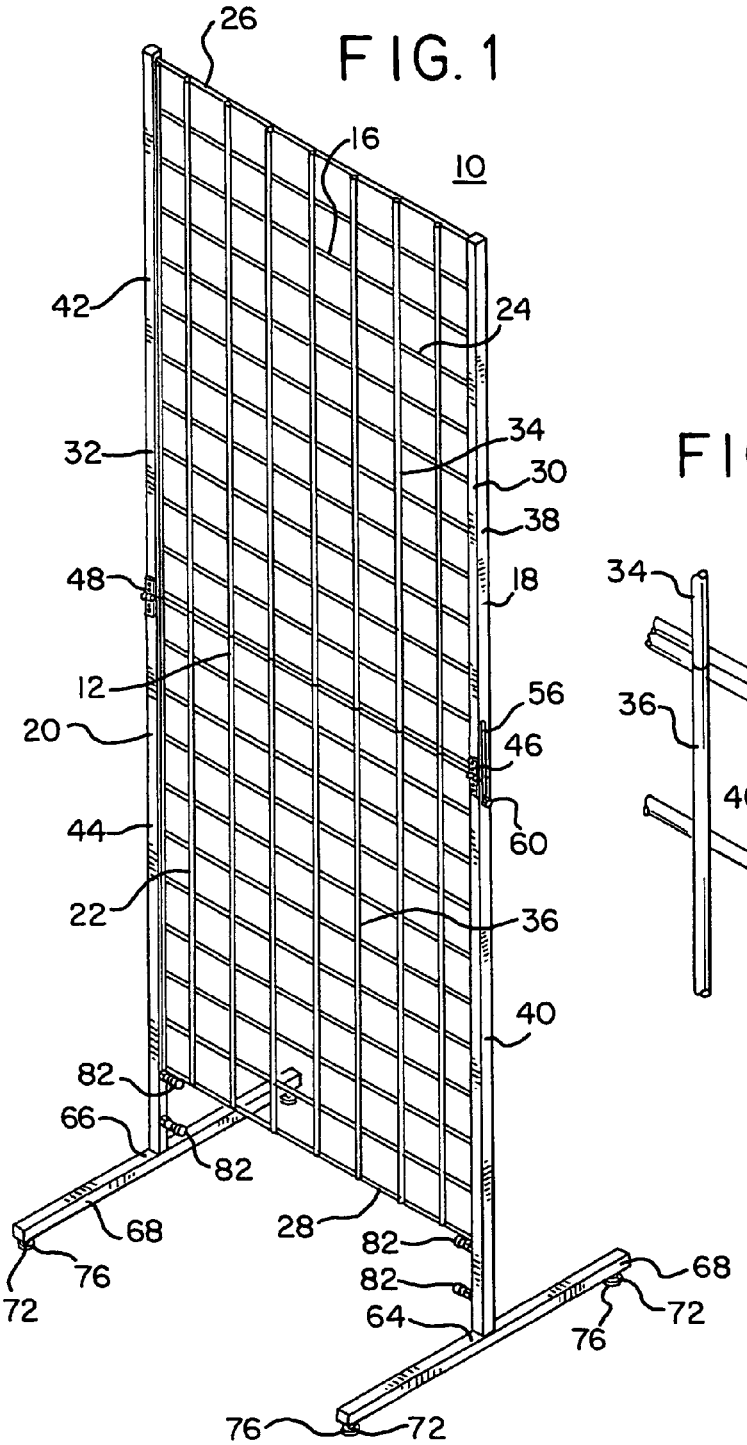
FIG. 1 is a top front perspective view of the Portable Display Stand Having Foldable One-Piece Vertical Support Panel That Is Capable Of Tool-Free Assembly And Disassembly ("Portable Display Stand") of the present invention showing an embodiment of the invention in the assembled condition with the vertical support panel sub-assembly in the unfolded position with the first slideable pin lock in the engaged position and the first locking mechanism in the locked position.

The present invention will now be described more fully with reference to the accompanying drawings, FIGS. 1-11, in which preferred embodiments of the invention are shown. The present invention, however, may be embodied in different forms and the invention should not be construed as constrained to the embodiments specifically described and illustrated herein.

Embodiments of the portable display stand 10, described as the invention, are illustrated in FIGS. 1-11 herein. As illustrated in more detail in FIGS. 1 through 5, portable display stand 10 includes vertical support panel sub-assembly 12. Vertical support panel sub-assembly 12 is perforated, slotted, gridded, or otherwise adapted to accept and support removable fixtures (not illustrated). The perforations, slots, grids, or other adaptations for accepting removable fixtures may include slatwall, gridwall, slatgrid, pegboard, or other designs known to skilled practitioners. For purposes of illustration, and not for reasons of limitation, a vertical support panel sub-assembly 12 made of gridwall 16 is shown in the drawings, though skilled practitioners would recognize that other panel materials could be substituted without departing from the invention. Removable fixtures may include hooks, braces, shelves, brackets, or other accessories for displaying or exhibiting merchandise.

Vertical support panel sub-assembly 12 has a first side 18, a second side 20, a front face 22, a back face 24, a top 26, and a bottom 28. Removable fixtures are generally removably attached or mounted to the front face 22 of vertical support panel sub-assembly 12. When mounted or attached, removable fixtures may extend substantially outwardly from the front face 22 of vertical support panel sub-assembly 12.

As illustrated in FIGS. 1-5, vertical support panel sub-assembly 12 is attached to and supported on its first side 18 by first vertical brace 30, and is attached to and supported on its second side 20 by second vertical brace 32. First vertical brace 30 and second vertical brace 32 are preferably made of hollow, tubular metal. First vertical brace 30 and second vertical brace 32 are preferably permanently attached to vertical support panel sub-assembly 12, such as by welding or soldering.

Figure 4:
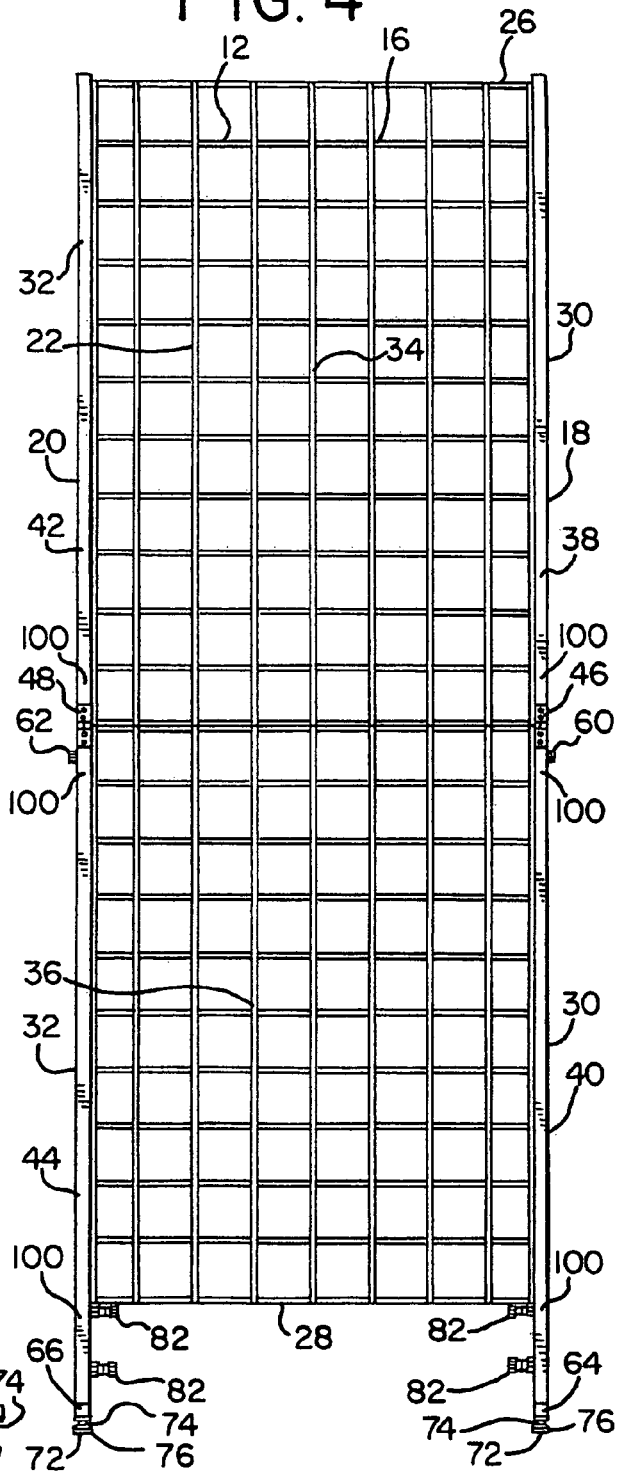
FIG. 4 is a front view of the Portable Display Stand embodiment of FIG. 1.
Figure 5:
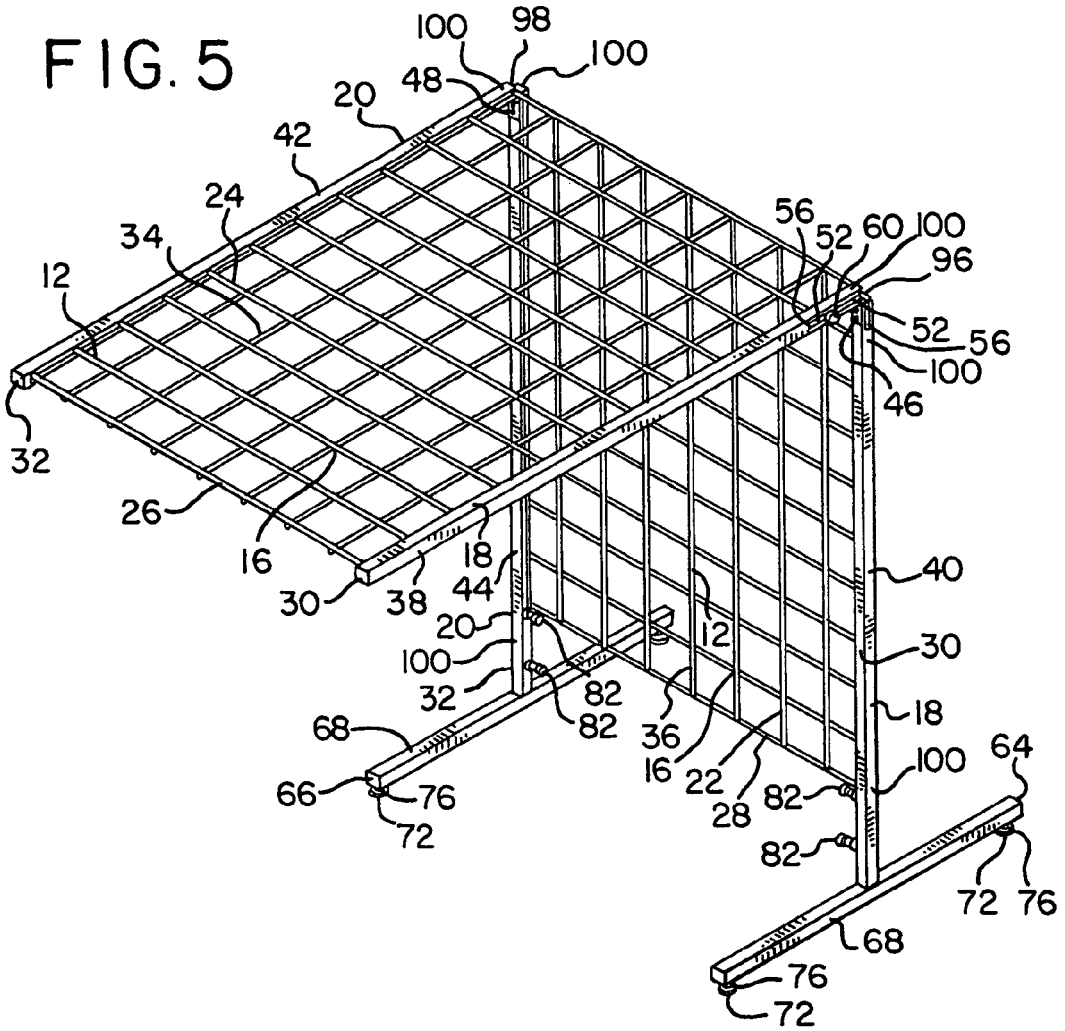
FIG. 5 is a top front perspective view of the Portable Display Stand embodiment of FIG. 1 with the vertical support panel sub-assembly in the partially folded position and the first and second slideable pin locks in the disengaged position.

As illustrated in FIGS. 1, 4, and 5, vertical support panel sub-assembly 12 is preferably split or divided into multiple segments. The vertical support panel sub-assembly 12 is preferably split into two segments, namely, a top panel segment 34 and a bottom panel segment 36, with the split occurring substantially in the horizontal direction across the front and back faces 22, 24 of vertical support panel sub-assembly 12, most preferably with the split occurring substantially near the vertical mid-point of the vertical support panel sub-assembly 12.

Similarly, first vertical brace 30 and second vertical brace 32 are split in the horizontal direction, with each split being at a location that corresponds with the split between the top panel segment 34 and the bottom panel segment 36. Thus, first vertical brace 30 is split into a first top brace 38 and a first bottom brace 40, while second vertical brace 32 is split into a second top brace 42 and second bottom brace 44. The split between the first top brace 38 and the first bottom brace 40 causes a first gap 96 to occur in the first vertical brace 30. Similarly, the split between the second top brace 42 and the second bottom brace 44 causes a second gap 98 to occur in the second vertical brace 32.

The first top brace 38 includes a hollow tubular portion 100 proximate to the first gap 96. The second top brace 42 includes a hollow tubular portion 100 proximate to the second gap 98. The first bottom brace 40 includes a hollow tubular portion 100 proximate to the first gap 96 and a hollow tubular portion 100 distal from the first gap 96. The second bottom brace 42 includes a hollow tubular portion 100 proximate to the second gap 98 and a hollow tubular portion 100 distal from the second gap 98.

Preferably, first top brace 38 is attached near the first gap 96 to first bottom brace 40 by a first hinge 46, and second top brace 42 is attached near the second gap 98 to the second bottom brace 44 by a second hinge 48. First bottom brace 40 and second bottom brace 44 are attached to (and preferably permanently attached to) bottom panel segment 36. First top brace 38 and second top brace 42 are attached to (and preferably permanently attached to) top panel segment 34. Consequently, as more particularly illustrated in FIG. 5, first hinge 46 (connecting first top brace 38 and first bottom brace 40) and second hinge 48 (connecting second top brace 42 and second bottom brace 44) permit top panel segment 34 and bottom panel segment 36 to rotate in a hinged manner from an unfolded, assembled position to a folded, disassembled position relative to each other. In the folded, disassembled position, top panel segment 34 and bottom panel segment 36, while still attached to each other via first hinge 46 and second hinge 48, may occupy approximately half the length of vertical support panel sub-assembly 12 in the unfolded assembled condition. Because vertical support panel sub-assembly 12 may be folded as described above, it may (when first leg sub-assembly 64 and second leg sub-assembly 66 are removed therefrom, as described later herein) be stowed in a relatively small space (such as in a carrying case 50) having approximately half the length that it would have if the vertical support panel sub-assembly 12 were not split into two segments and could not be folded (unless the panel were to be broken down into multiple pieces, but then the panel would suffer from, among other things, the disadvantages described herein of being a separate multi-piece construction).

The first hinge 46 and second hinge 48, moreover, serve critical functions during assembly of portable display stand 10. The first and second hinges 46, 48 aid in automatically aligning and partially stabilizing first top brace 38 and second top brace 42 relative to first bottom brace 40 and second bottom brace 44, respectively, when vertical support panel sub-assembly 12 is unfolded. The automatic alignment and stability provided by first and second hinges 46, 48 facilitates the ability to have hollow tubular portion 100 of the first top brace 38 proximate to first gap 96 line up properly with the hollow tubular portion 100 of the first bottom brace 40 proximate to first gap 96, and the hollow tubular portion 100 of second top brace 42 proximate to second gap 98 line up properly with the hollow tubular portion 100 of second bottom brace 44 proximate to second gap 98, so that first and second slideable pin locks 52, 54 may slide from their disengaged positions (locked substantially inside of the hollow tubular portion 100 of either first top brace 38 or first bottom brace 40, on the one hand, and inside of the hollow tubular portion 100 either second top brace 42, or second bottom brace 44, on the other), to their engaged positions (extending inside of and bridging the first gap 96 between the hollow tubular portions 100 of the first top brace 38 and first bottom brace 40, on the one hand, and extending inside of and bridging the second gap 98 between the hollow tubular portions 100 of the second top brace 42 and second bottom brace 44, on the other), as is described more fully herein.

As noted previously, first slideable pin lock 52, when in the disengaged position, fits substantially within (and preferably fits snugly within) the interior of hollow tubular portion 100 of first top brace 38 or (optionally) of first bottom brace 40. Similarly, second slideable pin lock 54, in the disengaged position, fits substantially within (and preferably fits snugly within) the interior hollow tubular portion 100 of second top brace 42 or (optionally) of second bottom brace 44.

As such, first and second slideable pin locks 52, 54 must have outside dimensions that are smaller than the inside dimensions of the hollow tubular portions 100 of first and second top braces 38, 42 and first and second bottom braces 40, 44, so as to allow the slideable pin locks 52, 54 to slide between their disengaged positions and their engaged positions. On the other hand, the outside dimensions of first and second slideable pin locks 52, 54 should fit somewhat snugly within the hollow tubular portions 100 of, respectively, first and second top braces 38, 42 and first and second bottom braces 40, 44 so as to impart substantial stability to the hinged connections between the first top and bottom braces 38, 40 and the second top and bottom braces 42, 44 when the first and second slideable pin locks 52, 54 are in the engaged position, as more fully described herein, thus imparting further stability as well to the resulting assembled position of top panel segment 34 and bottom panel segment 36 of vertical support panel sub-assembly 12.

Figure 2:
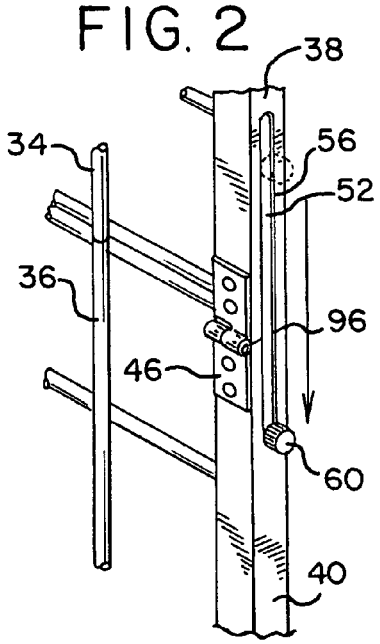
FIG. 2 is a front perspective close-up view of a portion of the Portable Display Stand embodiment of FIG. 1, showing the first locking slot with the first slideable pin lock in the engaged position and the first locking mechanism in the locked position.
Figure 3:
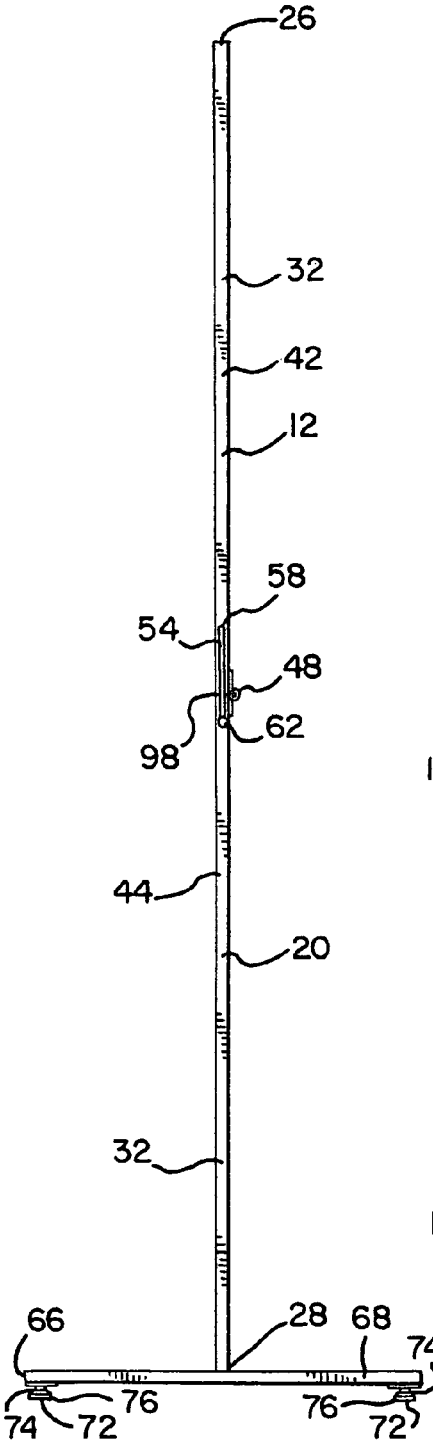
FIG. 3 is a second side (left side) view of the Portable Display Stand of FIG. 1 showing the second locking slot with the second slideable pin lock in the engaged position and the second locking mechanism in the locked position (the first side of the Portable Display Stand being a mirror image of the illustration in FIG. 3).
Figure 6:
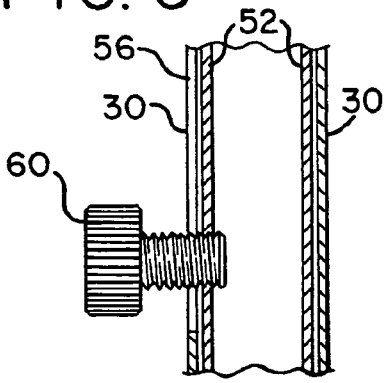
FIG. 6 is a rear cutaway view of a portion of the first vertical brace of the Portable Display Stand embodiment of FIG. 1, showing the first slideable pin lock in the engaged position within the hollow tubular portion of the first bottom brace at the first locking slot, with the first locking mechanism in the unlocked position (the second vertical brace, second bottom brace, second locking slot, second slideable pin lock in the engaged position, and second locking mechanism in the unlocked position being mirror images of the illustration in FIG. 6).
Figure 7:
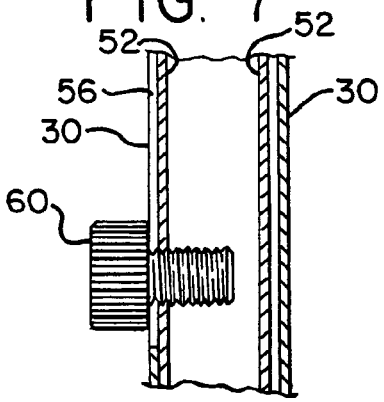
FIG. 7 is a rear cutaway view of a portion of the first vertical brace of the Portable Display Stand embodiment of FIG. 1, showing the first slideable pin lock in the engaged position within the hollow tubular portion of the first bottom brace at the first locking slot, with the first locking mechanism in the locked position engaging the sides of the first locking slot (the second vertical brace, second bottom brace, second locking slot, second slideable pin lock in the engaged position, and second locking mechanism in the locked position being mirror images of the illustration in FIG. 7).

Preferably, as illustrated more particularly in FIG. 2, a first locking slot 56 is formed in first top brace 38 and first bottom brace 40 proximate to first gap 96, and a second locking slot 58 is formed in second top brace 42 and second bottom brace 44 proximate to second gap 98. Referring to FIGS. 6 and 7, first slideable pin lock 52 may be locked in an engaged or disengaged position using first locking mechanism 60. Similarly, second locking mechanism 62 may lock second slideable pin lock 54 in an engaged or disengaged position. Preferably, first and second locking mechanisms 60, 62 are hand-lockable, and more preferably first and second locking mechanisms 60, 62 include hand-tightened bolts, wherein the heads of the bolts may engage and disengage with the edges of first locking slot 56 and second locking slot 58, respectively. First and second locking slots 56, 58 provide clearance for first and second slideable pin locks 52, 54 and, in particular, the first and second locking mechanisms 60, 62 to slide between the engaged and disengaged positions.

As previously discussed and as illustrated in FIG. 5, when the vertical support panel sub-assembly 12 is in the folded, disassembled position, the first and second slideable pin locks 52, 54 are in the disengaged position, that is, stored within the hollow tubular portions 100 of either the first top brace 38 or first bottom brace 40 (in the case of the first slideable pin lock 52), or within the hollow tubular portions 100 of the second top brace 42 or second bottom brace 44 (in the case of the second slideable pin lock 54). First and second locking mechanisms 60, 62 lock the disengaged first and second slideable pin locks 52, 54 in place, for example, by engaging the sides of first and second locking slots 56, 58, respectively. See FIGS. 6 and 7. In the illustrated embodiment, first and second locking mechanisms 60, 62 include hand-tightened bolts, and the heads of the bolts engage the edges of first and second locking slots 58, 60 when hand-tightened.

Referring again to FIGS. 1 through 5, when it is desired to assemble the vertical support panel sub-assembly 12, the top panel segment 34 and bottom panel segment 36 are unfolded by rotating first and second top braces 38, 42 with respect to first or second bottom braces 40, 44 around first and second hinges 46, 48. This is done until the hollow tubular portion 100 in the first top brace 38 proximate to the first gap 96 aligns with the hollow tubular portion 100 in the first bottom brace 40 proximate to the first gap 96. First and second hinges 46, 48 will then facilitate the automatic alignment of the hollow tubular portions 100 of the second top brace 42 and the second bottom brace 44 proximate to the second gap 98 as well.

With the hollow tubular portions 100 thus aligned at the first gap 96 and the second gap 98, the first and second slideable pin locks 52, 54 may be moved from the disengaged to engaged positions. In order to move first slideable pin lock 52 from the disengaged to engaged position, it must first be unlocked. First locking mechanism 60 is disengaged (such as by unscrewing in the illustrated embodiment where the locking mechanism is a hand-tightened bolt) from the edges of first locking slot 56. First slideable pin lock 52 is now free to slide from the hollow tubular portion 100 in which it is stored during disengagement. The process is repeated for second locking mechanism 62 of second slideable pin lock 54. See FIGS. 1 through 3, and 5 through 7.

Referring to FIGS. 1 through 7, to secure the first and second vertical braces 30, 32 in the unfolded, assembled position, first and second slideable pin locks 52, 54 are slid from the hollow tubular portions 100 in which they are stored into positions where they extend snugly into the hollow tubular portions 100 with which they are now aligned as a result of unfolding the vertical support panel sub-assembly 12, while simultaneously continuing to extend into the hollow tubular portions 100 in which they were previously stored (when the vertical support panel sub-assembly 12 was in the folded, disassembled position).

Addressing first slideable pin lock 52, for purposes of illustration, it is shown stored substantially within the hollow tubular portion 100 of first top brace 38 when vertical support panel sub-assembly 12 is in the folded, disassembled position (with the understanding that it could be stored in the hollow tubular portion 100 of the first bottom brace 40 without departing from the invention described herein). To secure vertical support panel sub-assembly 12 in the unfolded, assembled position, first slideable pin lock 52 is slid partially from its stored position in the hollow tubular portion 100 of first top brace 38 to extend partially into the hollow tubular portion 100 of first bottom brace 40. While so extended, a substantial portion of first slideable pin lock 52 remains within the hollow tubular portion 100 of first top brace 38. The first slideable pin lock 52 thereby forms a bridge between first top brace 38 and first bottom brace 40. First locking mechanism 60 (which is unlocked or disengaged from first locking slot 56) is provided clearance during sliding by first locking slot 56. After being extended as described above, first locking mechanism 60 is caused to be engaged (such as in the illustrated embodiment by hand-tightening of a bolt so that the head of the bolt engages with the sides of first locking slot 56), locking the first slideable pin lock 52 in the engaged position.

The first slideable pin lock 52, in the extended, engaged position described above, bridges the gap at the hinged connection between first top brace 38 and first bottom brace 40, locking and stabilizing the top panel segment 34 and bottom panel segment 36 of vertical support panel sub-assembly 12 in the unfolded, assembled position.

Similarly, second slideable pin lock 54 is shown stored substantially within the hollow tubular portion 100 of second top brace 42 when top panel segment 34 and bottom panel segment 36 of vertical support panel sub-assembly 12 are in the folded, disassembled position (under the same understanding discussed above). To further secure vertical support panel sub-assembly 12 in the unfolded, assembled position, second slideable pin lock 54 slides partially from its stored position in the hollow tubular portion 100 of second top brace 42 to extend partially into the hollow tubular portion 100 of second bottom brace 44, while a substantial portion of second slideable pin lock 54 remains within the hollow tubular portion 100 of second top brace 42. Second locking slot 58 provides clearance for second locking mechanism 62 to slide between the two positions described above. With second slideable pin lock 54 in the extended position described above, second locking mechanism 62 is caused to be engaged (in the illustrated embodiment, the bolt that is illustrated as the example of the second locking mechanism 62 is hand-tightened so that its head engages the sides of second locking slot 58), locking second slideable pin lock 54 in its extended, engaged position.

Second slideable pin lock 54 similarly bridges the second gap 98 at the hinged connection, this time between second top brace 42 and second bottom brace 44, further locking and providing enhanced stability to top panel segment 34 and bottom panel segment 36 of vertical support panel sub-assembly 12 in the unfolded, assembled position.

It is noteworthy and highly advantageous that assembly or disassembly of the vertical support panel sub-assembly 12 requires no addition to or dismantling of extra or loose parts from the vertical support panel sub-assembly 12. It is likewise noteworthy and desirable that the vertical support panel sub-assembly 12 may be assembled entirely by hand, without the necessity or employment of any tools.

The vertical support panel sub-assembly 12 discussed above is one of only three sub-assemblies (maximum) that combine to form portable display stand 10. The other two sub-assemblies are first leg sub-assembly 64 and second leg assembly 66, described more fully below.

Figure 8:
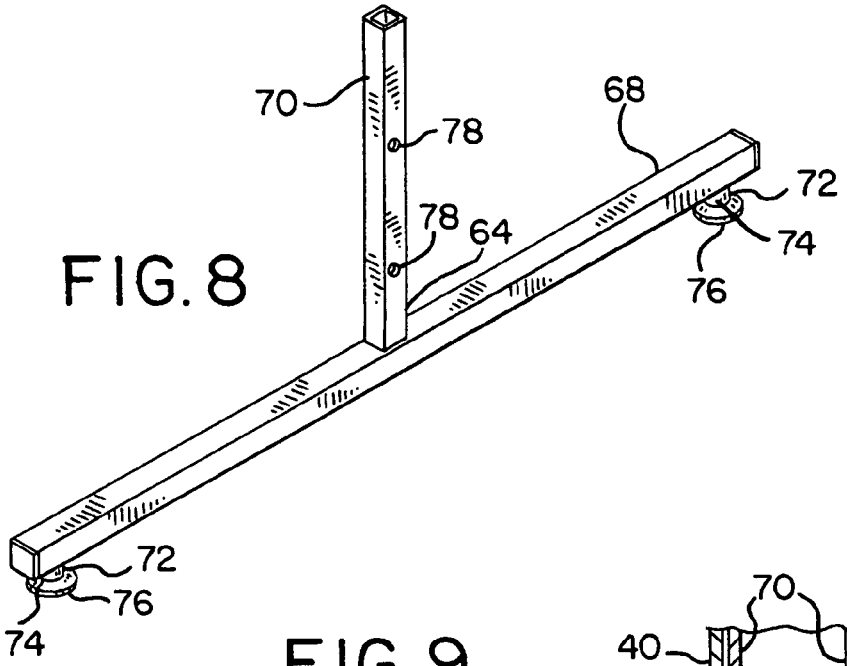
FIG. 8 is a top rear perspective view of the first leg sub-assembly of the Portable Display Stand embodiment of FIG. 1 (the second leg sub-assembly being the same configuration as the illustration of FIG. 8).

Referring to FIG. 8, preferably, first and second leg sub-assemblies 64, 66 are constructed in the same manner and are interchangeable. First leg sub-assembly 64 includes a horizontal leg support 68 and a vertical leg support 70. Preferably, vertical leg support 70 and horizontal leg support 68 are made from hollow tubular metal. Vertical leg support 70 of first leg sub-assembly 64 preferably extends transversely from horizontal leg support 68, and is permanently attached thereto, such as by welding or soldering.

Preferably, leg levelers 72 are attached to the bottom of horizontal leg support 68. Leg levelers may take many known forms, but one preferred form includes a headless bolt 74 terminating in horizontal feet 76. Preferably two leg levelers 72 may be connected to the bottom of horizontal leg support 68 by screwing or unscrewing the headless bolts 74 of horizontal leg support 68 to the extent desired to shorten or lengthen leg levelers 72 as needed to cause horizontal feet 76 to permit leveling of the first leg sub-assembly 64 on uneven surfaces. Casters (not shown) or other attachments may be attached to first horizontal leg sub-assembly 64 in lieu of leg levelers 72, or the leg levelers 72 may be omitted in their entirety, without departing from the invention.

Figure 9:
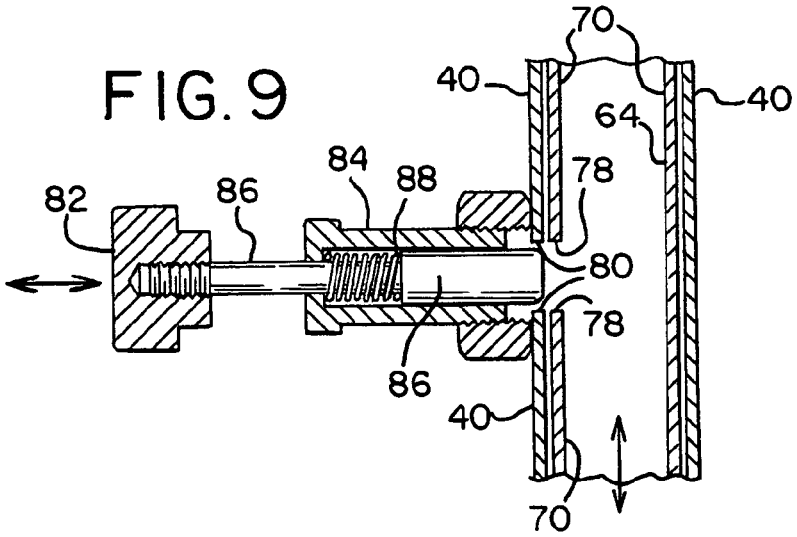
FIG. 9 is a front cutaway view of the bottom portion of the first vertical brace of the Portable Display Stand embodiment of FIG. 1, showing one of the attached spring plungers adjacent to the brace aperture and the aligned leg aperture of the first leg sub-assembly, with the plunger in the retracted disengaged position and the vertical leg support therefore free to slide within the first bottom brace. (The second vertical brace, second leg sub-assembly, aligned apertures, and associated spring plunger in the retraced disengaged position in the second vertical brace would be a mirror image of the illustration in FIG. 9).
Figure 10:
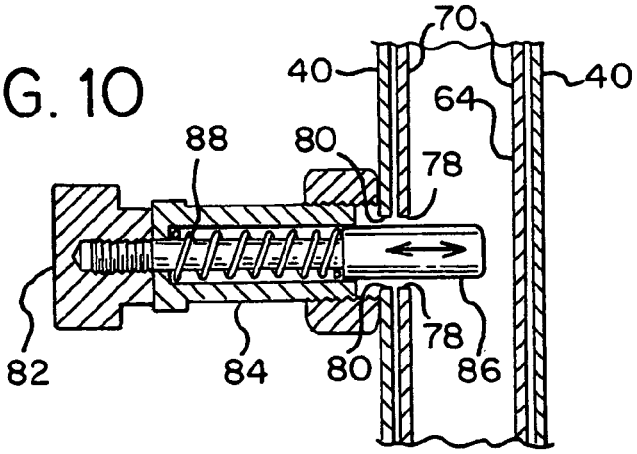
FIG. 10 is a front cutaway view of the bottom portion of the first vertical brace of the Portable Display Stand embodiment of FIG. 1, showing one of the attached spring plungers adjacent to the brace aperture and the aligned leg aperture of the first leg sub-assembly, with the plunger in the non-retracted engaged position and the vertical leg support therefore prevented from sliding out of the first bottom brace. (The second vertical brace, second leg sub-assembly, aligned apertures, and associated spring plunger in the non-retracted engaged position in the second vertical brace would be a mirror image of the illustration in FIG. 10).

Vertical leg support 70 of first leg sub-assembly 64 preferably extends from at or near the midpoint of horizontal leg support 68. Referring to FIGS. 9 and 10, vertical leg support 70 of first leg sub-assembly 64 is preferably of a dimension so as to fit snugly within the hollow tubular portion 100 of first bottom brace 40 distal from first gap 96 or second bottom brace 44 distal from second gap 98 (optionally, vertical leg support 70 may be of an interior tubular dimension such that the first bottom brace 40 or the second bottom brace 44 fits within the tubular top of vertical leg support 70 without departing from the invention described herein; however, the description and illustrations shall pertain to the preferred embodiment with vertical leg support 70 fitting within hollow tubular portion 100 of first bottom brace 40 or second bottom brace 44). Vertical leg support 70 of first leg sub-assembly 64 has one or more, and preferably two leg apertures 78 for interaction with tool-free attachments described further herein. Leg apertures 78 of vertical leg support 70 align with brace apertures 80 in first bottom brace 40 or second bottom brace 44 when vertical leg support 70 of first leg sub-assembly 64 is inserted into the hollow tubular portion 100 of first bottom brace 40 (distal from first gap 96) or second bottom brace 44 (distal from second gap 98). See FIGS. 1, and 3 through 5.

Tool-free attachments are preferably used to attach first leg sub-assembly 64 to either first bottom brace 40 or second bottom brace 44. As previously discussed, while a variety of tool-free attachments are suitable for attaching first leg sub-assembly 64 to either first or second bottom braces 40, 44, the preferred tool-free attachments would include spring-plungers 82.

Referring to FIGS. 9 and 10, spring-plungers 82 include a housing 84, a plunger 86, and a spring 88 within the housing 84 that biases the plunger 86 outwardly away from the housing 84. Spring-plungers 82 are attached to (and preferably permanently attached to) the hollow tubular portions 100 of first and second bottom braces 40, 44 at the ends distal from first and second gaps 96, 98 at a location adjacent to brace apertures 80 with the ends of plungers 86 inserted through brace apertures 80.

Referring to FIGS. 1, 4, 9, and 10, to attach first leg sub-assembly 64 to first (or second) bottom brace 40 (or 44), the vertical leg support 70 of first leg sub-assembly 64 is inserted into the hollow tubular portion 100 of first (or second) bottom brace 40 (or 44). Plungers 86 of spring-plungers 82 associated with first and second bottom braces 40, 44 are biased by springs 88 so as to cause plungers 82 to extend through brace apertures 80 into the interior of the hollow tubular portions 100 of first and second bottom braces 40, 44. Plungers 86 are manually retracted out of the interior of the hollow tubular portions 100 of first or second bottom braces 40, 44 (by pulling against the springs 88) allowing leg apertures 78 of vertical leg support 70 to align with brace apertures 80 of first or second bottom braces 40, 44. Plungers 86 of spring-plungers 82 may then be released. Springs 88 of spring-plungers 82 then bias plungers 86 causing plungers 86 to extend through brace apertures 80 and aligned leg apertures 78, causing first leg sub-assembly 64 to become attached (on a removable basis) to first or second bottom brace 40, 44 quickly and easily without the use of any tools. Tool-free disassembly occurs by reversing the described process.

Second leg sub-assembly 66 preferably may be constructed in substantially the same manner as first leg sub-assembly 64, and may be (and preferably is) interchangeable therewith. Second leg sub-assembly 66 may be attached to first or second bottom brace 40, 44 (whichever brace is not attached to first leg sub-assembly 64) in the same manner described above for first leg sub-assembly 64.

First and second leg sub-assemblies 64, 66 are two of a total of only three (maximum) sub-assemblies that combine to form portable display stand 10. As described, first and second leg sub-assemblies 64, 66 may be assembled to the remaining third sub-assembly, namely, the vertical support panel sub-assembly 12, without requiring the addition of any extra loose parts. Moreover, assembly of and disassembly of the three sub-assemblies may occur entirely without tools.

Figure 11:
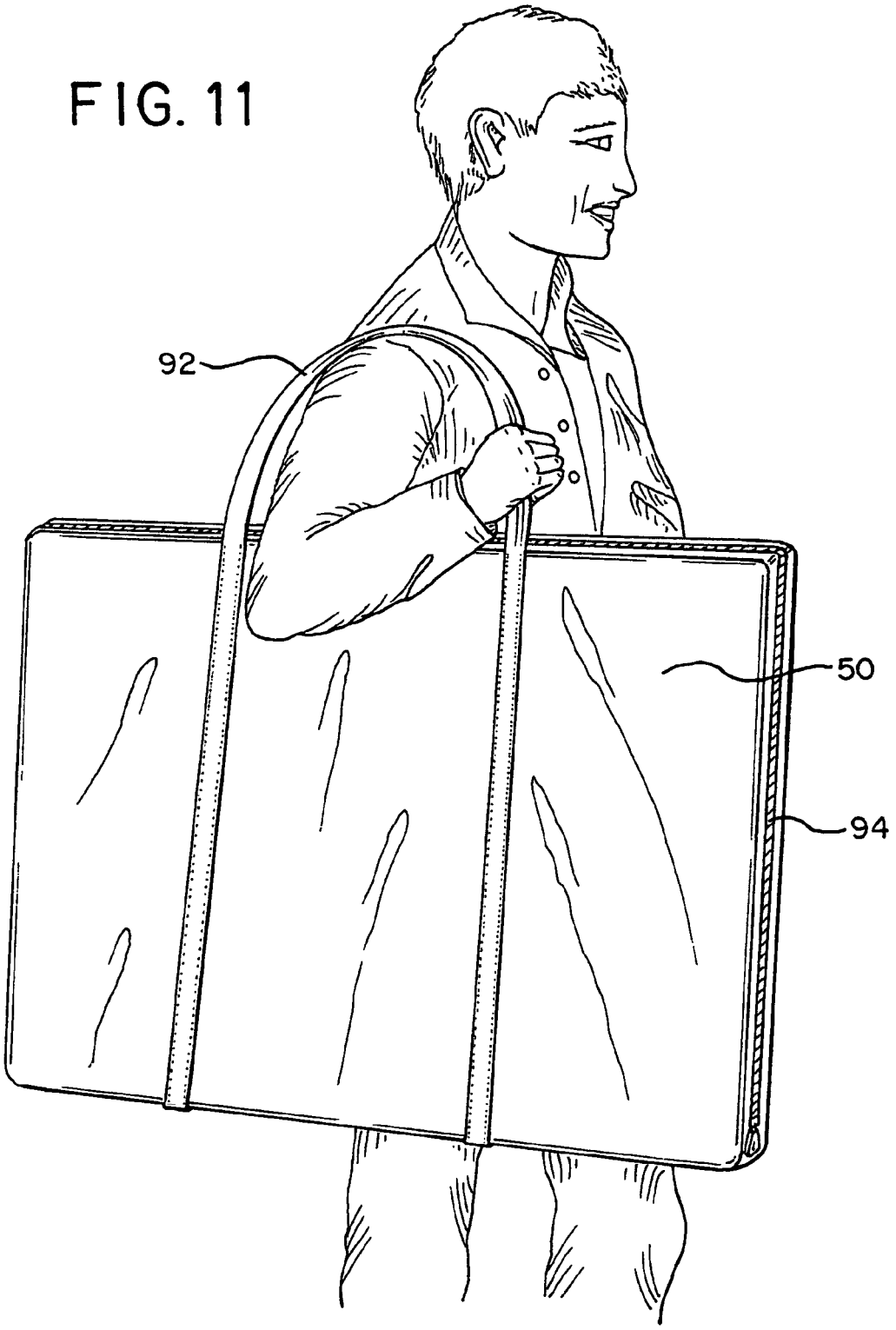
FIG. 11 is a side view of the carrying case enclosing the three disassembled sub-assemblies of the embodiment of the Portable Display Stand of FIG. 1.

Referring to FIG. 11, to facilitate storage and transport of portable display stand 10, a carrying case 50 may be supplied. Carrying case 50 is preferably constructed of a durable flexible fabric or other suitable material, such as ballistic nylon. Carrying case 50 may include a handle (not illustrated) or a shoulder strap 92, or both, for transport of the carrying case 50. Carrying case 50 is sized so as to enclose the preferably maximum three sub-assemblies of portable display stand 10 in a disassembled condition, namely, vertical support panel sub-assembly 12 (in folded form), first leg sub-assembly 64, and second leg sub-assembly 66. Closure 94, preferably including a zipper, secures the three sub-assemblies within carrying case 50. A handle or shoulder strap 92 permits lifting and transport of the carrying case 50 containing portable display stand 10 in the disassembled condition. Indeed, shoulder strap 92 permits lifting and hands-free transport of same (with carrying case 50 being slung across the shoulder of the person doing the carrying).

The invention described above simultaneously meets a number of previous needs in the marketplace. The portable display stand 10 may be quickly and easily assembled or disassembled, entirely without tools. This is highly advantageous especially when the portable display stand 10 is being transported to and erected at a remote location, such as a trade show. The user of the portable display stand 10 is not required, in addition to transporting the portable display stand 10, to bring a number of different tools or a heavy tool box, with the extra effort and expense (such as baggage fees) that may entail in traveling to a remote location.

The portable display stand 10 of the present invention is compact, and may easily fit in a compact carrying case 50. It may thereby be easily transported by hand (using a handle or shoulder strap) or in a more convenient hands-free manner (using shoulder strap 92). It is highly compact in the folded, disassembled condition due to the split, hinged construction of vertical support panel sub-assembly 12. On the other hand, the first and second hinges 46, 48 and first and second slideable pin locks 52, 54 impart considerable stability to the folding structure of the vertical support panel sub-assembly 12. Moreover, the three (maximum) sub-assembly construction of the preferred embodiment avoids loss of small pieces or damage to the individual components that often occurs during transport or storage when a larger number of smaller or loose pieces required for assembly and disassembly are transported in a container.

Moreover, the hinged construction of the multi-segment vertical support panel sub-assembly 12 greatly facilitates alignment and stabilization of the panel during assembly, which greatly speeds the assembly process. Unlike prior art display stands, the user-friendly portable display stand 10 of this invention may be completely assembled, even by an inexperienced user, in less than a minute, largely due to the stabilization and superior alignment imparted by first and second hinges 46, 48 and first and second slideable pin locks 52, 54 in combination with the tool-free assembly described herein.

Finally, tool-free assembly and disassembly of portable display stand 10 carries other benefits as well, especially in the context of trade shows or exhibitions. Exhibition halls and convention centers often have strict rules requiring that when assembly and disassembly of displays and other fixtures require the use of tools, the work is not permitted to be performed by the exhibitor, but must instead be performed by exhibition hall/convention center tradesmen, at a cost, often a considerable cost, to the exhibitor. By eliminating the need for tools during assembly and disassembly of one or more portable display stands 10, the requirement for hiring exhibition hall/convention center tradesmen may be avoided, and the exhibitor may assemble the portable display stands 10 himself or herself, without using tools, thereby realizing a considerable cost savings. Thus, the invention described herein, due to its advantages, would constitute a highly productive addition to the user's inventory of displays.

While the invention has been described with reference to specific embodiments, it will be appreciated that modifications and changes may be made by skilled practitioners without departing from the scope of the invention, which is defined by the claims. In particular, it is to be realized that optimal dimensional relationships for the components of the present invention may include variations in size, materials, shape, form, and manner of operation.

We claim:

1. A portable display stand comprising:

(1) A vertical support panel sub-assembly that includes a top panel segment and a bottom panel segment, wherein the top panel segment has a first side and a second side, and wherein the bottom panel segment has a first side and a second side, and wherein the vertical support panel sub-assembly further includes:

(A) A first top brace that is permanently attached to the first side of the top panel segment, and a first bottom brace that is permanently attached to the first side of the bottom panel segment, with a first gap located between the first top brace and the first bottom brace;

(B) A second top brace that is permanently attached to the second side of the top panel segment, and a second bottom brace that is permanently attached to the second side of the bottom panel segment, with a second gap located between the second top brace and the second bottom brace;

(C) A first hinge that is located adjacent to the first gap and forms a connection between the first top brace and the first bottom brace, and a second hinge that is located adjacent to the second gap and that forms a connection between the second top brace and the second bottom brace, wherein the first hinge and the second hinge permit the top panel segment and the bottom panel segment of the vertical support panel sub-assembly to rotate at the first hinge and second hinge between an open position and a closed position;

(D) A hollow tubular portion in the first top brace proximate to the first gap, and a hollow tubular portion in the first bottom brace proximate to the first gap;

(E) A hollow tubular portion in the second top brace proximate to the second gap, and a hollow tubular portion in the second bottom brace proximate to the second gap;

(F) A first slideable pin lock that is movable between an engaged position and a disengaged position which:

(i) When the top panel segment and the bottom panel segment of the vertical support panel sub-assembly are in the closed position, and the first slideable pin lock is in the disengaged position, then the first slideable pin lock is located substantially within either: (a) the hollow tubular portion of the first top brace proximate to the first gap, or (b) the hollow tubular portion of the first bottom brace proximate to the first gap, but the first slideable pin lock is not simultaneously located substantially within both the hollow tubular portion of the first top brace proximate to the first gap and substantially within the hollow tubular portion of the first bottom brace proximate to the first gap; and (ii) When the top panel segment and the bottom panel segment of the vertical support panel sub-assembly are in the open position, the first slideable pin lock may be moved into the engaged position, wherein at least a portion of the first slideable pin lock simultaneously: (a) is located substantially within the hollow tubular portion of the first brace proximate to the first gap, and is also located substantially within the hollow tubular portion of the first bottom brace proximate to the first gap, and (b) forms a first bridge at the first gap between the first top brace proximate to the first gap and the first bottom brace proximate to the first gap;

(G) A second slideable pin lock that is moveable between an engaged position and a disengaged position which:

(i) When the top panel segment and the bottom panel segment of the vertical support panel sub-assembly are in the closed position, and the second slideable pin lock is in the disengaged position, then the second slideable pin lock is located substantially within either: (a) the hollow tubular portion of the second top brace proximate to the second gap, or (b) the hollow tubular portion of the second bottom brace proximate to the second gap, but the second slideable pin lock is not simultaneously located substantially within both the hollow tubular portion of the second top brace proximate to the second gap and substantially within the hollow tubular portion of the second bottom brace proximate to the second gap; and (ii) When the top panel segment and the bottom panel segment of the vertical support panel sub-assembly are in the open position, the second slideable pin lock may be moved into the engaged position, wherein at least a portion of the second slideable pin lock simultaneously: (a) is located substantially within the hollow tubular portion of the second top brace proximate to the second gap, and is also located substantially within the hollow tubular portion of the second bottom brace proximate to the second gap, and (b) forms a second bridge at the second gap between the second top brace proximate to the second gap and the second bottom brace proximate to the second gap;

(H) A first locking mechanism for the first slideable pin lock which is movable between a locked position, wherein the first locking mechanism prevents the first slideable pin lock from moving between the engaged position and the disengaged position, and an unlocked position, wherein the first locking mechanism does not prevent the first slideable pin lock from moving between the engaged position and the disengaged position;

(I) A second locking mechanism for the second slideable pin lock which is movable between a locked position, wherein the second locking mechanism prevents the second slideable pin lock from moving between the engaged position and the disengaged position, and an unlocked position, wherein the second locking mechanism does not prevent the second slideable pin lock from moving between the engaged position and the disengaged position;

(J) When the top panel segment and the bottom panel segment of the vertical support panel sub-assembly are in the closed position, the first locking mechanism of the first slideable pin lock may be moved to a locked position with the first slideable pin lock in the disengaged position, and when the top panel segment and the bottom panel segment of the vertical support panel sub-assembly are in the open position, the first locking mechanism of the first slideable pin lock may be moved to a locked position with the first slideable pin lock in the engaged position;

(K) When the top panel segment and the bottom panel segment of the vertical support panel sub-assembly are in the closed position, the second locking mechanism of the second slideable pin lock may be moved to a locked position with the second slideable pin lock in the disengaged position, and when the top panel segment and the bottom panel segment of the vertical support panel sub-assembly are in the open position, the second locking mechanism of the second slideable pin lock may be moved to a locked position with the second slideable pin lock in the engaged position;

(L) A first bottom hollow tubular portion in the first bottom brace that is distal from the first gap, and a second bottom hollow tubular portion in the second bottom brace that is distal from the second gap;

(M) One or more brace apertures located in the first bottom tubular portion of the first bottom brace, wherein one or more spring plungers are attached to the first bottom brace adjacent the brace apertures;

(N) One or more brace apertures located in the second bottom tubular portion of the second bottom brace, wherein one or more spring plungers are attached to the second bottom brace adjacent the brace apertures;

(O) The spring plungers of the first bottom brace further including a plunger biased by a spring in a direction so as to extend through the brace apertures of the first brace, and wherein each of the spring plungers of the first bottom brace has an engaged position and a disengaged position, wherein:

(i) In the disengaged position, the plunger is retracted against the bias of the spring, and the plunger does not extend substantially through the brace apertures of the first brace; and (ii) In the engaged position, the plunger is not retracted and is biased by the spring so that it may extend substantially through the brace apertures of the first brace; and (P) The spring plungers of the second bottom brace further including a plunger biased by a spring in a direction so as to extend through the brace apertures of the second brace, and wherein each of the spring plungers of the second bottom brace has an engaged position and a disengaged position, wherein:

(i) In the disengaged position, the plunger is retracted against the bias of the spring, and the plunger does not extend substantially through the brace apertures of the second brace; and (ii) In the engaged position, the plunger is not retracted and is biased by the spring so that it may extend substantially through the brace apertures of the second brace; and (2) A first leg sub-assembly detachable from the vertical support panel sub-assembly that includes a first horizontal leg support and a first vertical leg support permanently attached to the first horizontal leg support, wherein:

(A) The first vertical leg support includes one or more leg apertures;

(B) The outer cross-sectional dimensions of the first vertical leg support are smaller than the inner cross-sectional dimensions of the first bottom hollow tubular portion of the first bottom brace; and (C) The first vertical leg support is insertable into the first bottom hollow tubular portion of the first bottom brace, wherein:

(i) One or more of the brace apertures of the first bottom brace may become located and aligned adjacent to the leg apertures of the first vertical leg support when the spring plungers of the first bottom brace are in the disengaged position;

(ii) When the spring plungers of the first bottom brace are in the engaged positions, the springs of the spring plungers may bias the plungers of the spring plungers to extend through the brace apertures of the first bottom brace and through the adjacent and aligned leg apertures of the first vertical leg support, resulting in a removable attachment of the first leg sub-assembly to the first bottom brace; and (3) A second leg sub-assembly detachable from the vertical support panel sub-assembly and not attachable to the first leg sub-assembly that includes a second horizontal leg support and a second vertical leg support permanently attached to the second horizontal leg support, wherein:

(A) The second vertical leg support includes one or more leg apertures;

(B) The outer cross-sectional dimensions of the second vertical leg support are smaller than the inner cross-sectional dimensions of the second bottom hollow tubular portion of the second bottom brace; and (C) The second vertical leg support is insertable into the second bottom hollow tubular portion of the second bottom brace, wherein:

(i) One or more of the brace apertures of the second bottom brace may become located and aligned adjacent to the leg apertures of the second vertical leg support when the spring plungers of the second bottom brace are in the disengaged position; and (ii) When the spring plungers of the second bottom brace are in the engaged positions, the springs of the spring plungers may bias the plungers of the spring plungers to extend through the brace apertures of the second bottom brace and through the adjacent and aligned leg apertures of the second vertical leg support, resulting in a removable attachment of the second leg sub-assembly to the first bottom brace.

2. The portable display stand of claim 1 wherein, when the top panel segment and the bottom panel segment of the vertical support panel sub-assembly are in the closed position and the first slideable pin lock is in the disengaged position, then the first slideable pin lock is located substantially within the hollow tubular portion of the first top brace proximate to the first gap.

3. The portable display stand of claim 2 wherein, when the top panel segment and the bottom panel segment of the vertical support panel sub-assembly are in the closed position and the second slideable pin lock is in the disengaged position, then the second slideable pin lock is located substantially within the hollow tubular portion of the second top brace proximate to the second gap.

4. The portable display stand of claim 1 wherein the portable display stand comprises no more than three sub-assemblies, namely, the vertical support panel sub-assembly, the first leg sub-assembly, and the second leg sub-assembly.

5. The portable display stand of claim 1 wherein the sub-assemblies may be assembled to each other by hand without using tools.

6. The portable display stand of claim 4 wherein the sub-assemblies may be assembled by hand without the necessity of using tools.

7. A portable display stand comprising:

(1) A vertical support panel sub-assembly that includes a top panel segment and a bottom panel segment, wherein the top panel segment has a first side and a second side, and wherein the bottom panel segment has a first side and a second side, and wherein the vertical support panel sub-assembly further includes:

(A) A first top brace that is permanently attached to the first side of the top panel segment, and a first bottom brace that is permanently attached to the first side of the bottom panel segment, with a first gap located between the first top brace and the first bottom brace;

(B) A second top brace that is permanently attached to the second side of the top panel segment, and a second bottom brace that is permanently attached to the second side of the bottom panel segment, with a second gap located between the second top brace and the second bottom brace;

(C) A first hinge that is located adjacent to the first gap and forms a connection between the first top brace and the first bottom brace, and a second hinge that is located adjacent to the second gap and that forms a connection between the second top brace and the second bottom brace, wherein the first hinge and the second hinge permit the top panel segment and the bottom panel segment of the vertical support panel sub-assembly to rotate at the first hinge and second hinge between an open position and a closed position;

(D) hollow tubular portion in the first top brace proximate to the first gap, and a hollow tubular portion in the first bottom brace proximate to the first gap;

(E) A hollow tubular portion in the second top brace proximate to the second gap, and a hollow tubular portion in the second bottom brace proximate to the second gap;

(F) A first slideable pin lock that is movable between an engaged position and a disengaged position which:

(i) When the top panel segment and the bottom panel segment of the vertical support panel sub-assembly are in the closed position, and the first slideable pin lock is in the disengaged position, then the first slideable pin lock is located substantially within either: (a) the hollow tubular portion of the first top brace proximate to the first gap, or (b) the hollow tubular portion of the first bottom brace proximate to the first gap, but the first slideable pin lock is not simultaneously located substantially within both the hollow tubular portion of the first top brace proximate to the first gap and the hollow tubular portion of the first bottom brace proximate to the first gap; and (ii) When the top panel segment and the bottom panel segment of the vertical support panel sub-assembly are in the open position, the first slideable pin lock may be moved into the engaged position, wherein at least a portion of the first slideable pin lock simultaneously: (a) is located substantially within the hollow tubular portion of the first brace proximate to the first gap, and is also located substantially within the hollow tubular portion of the first bottom brace proximate to the first gap, and (b) forms a first bridge at the first gap between the first top brace proximate to the first gap and the first bottom brace proximate to the first gap; and (2) A first leg sub-assembly detachable from the vertical support panel sub-assembly that includes a first horizontal leg support and a first vertical leg support permanently attached to the first horizontal leg support, wherein the first vertical leg support of the first leg sub-assembly is removably attachable to the first bottom brace of the vertical support panel sub-assembly.

8. The portable display stand of claim 7 further comprising a second leg sub-assembly detachable from the vertical support panel sub-assembly and not attachable to the first leg sub-assembly that includes a second horizontal leg support and second vertical leg support attached to the second horizontal leg support, wherein the second vertical leg support of the second leg sub-assembly is removably attachable to the second bottom brace of the vertical support panel sub-assembly.

9. The portable display stand of claim 8 wherein the first vertical leg support is permanently attached to the first horizontal leg support, and the second vertical leg support is permanently attached to the second horizontal leg support.

10. The portable display stand of claim 8, further comprising a second slideable pin lock that is moveable between an engaged position and a disengaged position which:

(1) When the top panel segment and the bottom panel segment of the vertical support panel sub-assembly are in the closed position, and the second slideable pin lock is in the disengaged position, then the second slideable pin lock is located substantially within either: (A) the hollow tubular portion of the second top brace proximate to the second gap, or (B) the hollow tubular portion of the second bottom brace proximate to the second gap, but the second slideable pin lock is not simultaneously located substantially within both the hollow tubular portion of the second top brace proximate to the second gap and substantially within the hollow tubular portion of the second bottom brace proximate to the second gap; and (2) When the top panel segment and the bottom panel segment of the vertical support panel sub-assembly are in the open position, the second slideable pin lock may be moved into the engaged position, wherein at least a portion of the second slideable pin lock simultaneously: (A) is located substantially within the hollow tubular portion of the second top brace proximate to the second gap, and is also located substantially within the hollow tubular portion of the second bottom brace proximate to the second gap, and (B) forms a second bridge at the second gap between the second top brace proximate to the second gap and the second bottom brace proximate to the second gap.

11. The portable display stand of claim 9 further comprising a second slideable pin lock that is movable between an engaged position and a disengaged position which:

(1) When the top panel segment and the bottom panel segment of the vertical support panel sub-assembly are in the closed position, and the second slideable pin lock is in the disengaged position, then the second slideable pin lock is located substantially within either: (A) the hollow tubular portion of the second top brace proximate to the second gap, or (B) the hollow tubular portion of the second bottom brace proximate to the second gap, but the second slideable pin lock is not simultaneously located substantially within both the hollow tubular portion of the second top brace proximate to the second gap and substantially within the hollow tubular portion of the second bottom brace proximate to the second gap; and (2) When the top panel segment and the bottom panel segment of the vertical support panel sub-assembly are in the open position, the second slideable pin lock may be moved into the engaged position, wherein at least a portion of the second slideable pin lock simultaneously: (A) is located substantially within the hollow tubular portion of the second top brace proximate to the second gap, and is also located substantially within the hollow tubular portion of the second bottom brace proximate to the second gap, and (B) forms a second bridge at the second gap between the second top brace proximate to the second gap and the second bottom brace proximate to the second gap.

12. The portable display stand of claim 8, further comprising:

(1) A first locking mechanism for the first slideable pin lock which is movable between a locked position, wherein the first locking mechanism prevents the first slideable pin lock from moving between the engaged position and the disengaged position, and an unlocked position, wherein the first locking mechanism does not prevent the first slideable pin lock from moving between the engaged position and the disengaged position; and (2) When the top panel segment and the bottom panel segment of the vertical support panel sub-assembly are in the closed position, the first locking mechanism of the first slideable pin lock may be moved to a locked position with the first slideable pin lock in the disengaged position, and when the top panel segment and the bottom panel segment of the vertical support panel sub-assembly are in the open position, the first locking mechanism of the first slideable pin lock may be moved to a locked position with the first slideable pin lock in the engaged position.

13. The portable display stand of claim 9 further comprising:

(1) A first locking mechanism for the first slideable pin lock which is movable between a locked position, wherein the first locking mechanism prevents the first slideable pin lock from moving between the engaged position and the disengaged position, and an unlocked position, wherein the first locking mechanism does not prevent the first slideable pin lock from moving between the engaged position and the disengaged position; and (2) When the top panel segment and the bottom panel segment of the vertical support panel sub-assembly are in the closed position, the first locking mechanism of the first slideable pin lock may be moved to a locked position with the first slideable pin lock in the disengaged position, and when the top panel segment and the bottom panel segment of the vertical support panel sub-assembly are in the open position, the first locking mechanism of the first slideable pin lock may be moved to a locked position with the first slideable pin lock in the engaged position.

14. The portable display stand of claim 10 further comprising:

(1) A first locking mechanism for the first slideable pin lock which is movable between a locked position, wherein the first locking mechanism prevents the first slideable pin lock from moving between the engaged position and the disengaged position, and an unlocked position, wherein the first locking mechanism does not prevent the first slideable pin lock from moving between the engaged position and the disengaged position;

(2) A second locking mechanism for the second slideable pin lock which is movable between a locked position, wherein the second locking mechanism prevents the second slideable pin lock from moving between the engaged position and the disengaged position, and an unlocked position, wherein the second locking mechanism does not prevent the second slideable pin lock from moving between the engaged position and the disengaged position;

(3) When the top panel segment and the bottom panel segment of the vertical support panel sub-assembly are in the closed portion, the first locking mechanism of the first slideable pin lock may be moved to a locked position with the first slideable pin lock in disengaged position, and when the top panel segment and the bottom panel segment of the vertical support panel sub-assembly are in the open position, the first locking mechanism of the first slideable pin lock may be moved to a locked position with the first slideable pin lock in the engaged position; and (4) When the top panel segment and the bottom panel segment of the vertical support panel sub-assembly are in the closed position, the second locking mechanism of the second slideable pin lock may be moved to a locked position with the second slideable pin lock in the disengaged position, and when the top panel segment and the bottom panel segment of the vertical support panel sub-assembly are in the open position, the second locking mechanism of the second slideable pin lock may be moved to a locked position with the second slideable pin lock in the engaged position.

15. The portable display stand of claim 9 wherein the first leg sub-assembly is removably attachable to the first bottom brace using one or more spring plungers, and wherein the second leg sub-assembly is removably attachable to the second bottom brace using one or more spring plungers.

16. The portable display stand of claim 11 wherein the first leg sub-assembly is removably attachable to the first bottom brace using one or more spring plungers, and wherein the second leg sub-assembly is removably attachable to the second bottom brace using one or more spring plungers.

17. The portable display stand of claim 13 wherein the first leg sub-assembly is removably attachable to the first bottom brace using one or more spring plungers, and wherein the second leg sub-assembly is removably attachable to the second bottom brace using one or more spring plungers.

18. The portable display stand of claim 14 wherein the first leg sub-assembly is removably attachable to the first bottom brace using one or more spring plungers, and wherein the second leg sub-assembly is removably attachable to the second bottom brace using one or more spring plungers.

19. The portable display stand of claim 18 wherein the portable display stand comprises no more than three sub-assemblies, namely, the vertical support panel sub-assembly, the first leg sub-assembly, and the second leg sub-assembly.

20. The portable display stand of claim 19 wherein the sub-assemblies may be assembled to each other by hand without using tools.

* * * * *